United States Patent [19]

Nakayama et al.

[11] Patent Number: 4,779,081

[45] Date of Patent: Oct. 18, 1988

[54] GRAPHICS IN DISPLAY UNIT

[75] Inventors: Yoshiyuki Nakayama, Yokohama; Akio Hayaski, Narashino; Shinji Kimura; Kenjiro Mori, both of Yokohama, all of Japan

[73] Assignee: Hitachi, Ltd., Tokyo, Japan

[21] Appl. No.: 894,860

[22] Filed: Aug. 8, 1986

[30] Foreign Application Priority Data

Aug. 16, 1985 [JP] Japan ..... 60-179485

[51] Int. Cl.[4] ..... G09G 1/16

[52] U.S. Cl. ..... 340/721; 340/734; 340/747

[58] Field of Search ..... 340/721, 723, 722, 729, 340/747, 731, 744, 734, 365 VL

[56] References Cited

U.S. PATENT DOCUMENTS

| | | | |
|---|---|---|---|
| 3,497,760 | 2/1970 | Kiesling | 340/731 |
| 3,639,736 | 2/1972 | Sutherland | 340/721 |
| 4,492,956 | 1/1985 | Collmeyer et al. | 340/731 |
| 4,550,315 | 10/1985 | Bass et al. | 340/747 |
| 4,555,775 | 11/1985 | Pike | 340/734 |
| 4,586,035 | 4/1986 | Baker et al. | 340/365 VL |
| 4,623,880 | 11/1986 | Bresenham et al. | 340/744 |

*Primary Examiner*—Gerald L. Brigance
*Assistant Examiner*—Mahmoud Fatahi-yar
*Attorney, Agent, or Firm*—Antonelli, Terry & Wands

[57] ABSTRACT

A method of drawing figures for a multi-window system in which a plurality of window regions are set on a display screen, and in which a window which is partly overlapped on other windows and is partly concealed is controlled by being divided into a plurality of display or non-display subregions, and the displayed content is changed by designating the window. If a dot constituting the figure is generated from a dot generator, coordinate values of the dot are compared with position data of the designated window to select a dot located in the window. The selected dot is compared with position data of a subregion that constitutes the designated window to find a particular subregion in which the dot exists. If the particular subregion is a display region, the dot located therein is produced on the display screen. A dot generated next is compared with the particular subregion and is determined to be displayed or not. When the dot lies outside the particular subregion, the region to be compared to the dot position data is changed, and the dot position is compared with another subregion or with the designated window.

4 Claims, 7 Drawing Sheets

GRAPHICS IN DISPLAY UNIT

BACKGROUND OF THE INVENTION

1. Field of the Invention

The present invention relates to graphics in a display unit. More specifically, the invention relates to a method of drawing figures in a multi-window system in which a plurality of rectangular regions called windows are set on a display screen of a display unit of the raster scanning type, the figures being drawn on a window that is partially covered with other windows and that partly forms a non-display region.

2. Description of the Prior Art

In a computer graphics display system, a method has heretofore been employed to clip a figure on a drawing region in order to display a figure of a size in excess of the size of the display screen or to produce a drawing output for a particular region that is set on a portion of the display screen. According to a representative method of drawing figures as disclosed, for example, in Japanese Patent Laid-Open No. 225473/1983, a portion included in a drawing region in the whole figure is judged based upon an equation that mathematically expresses the figure to be drawn, and the output is sent to the display device according to the judged result.

The advantage of this method is that when a straight line passing through points A and B is to be described in a particular drawing region on the display screen, a start point and an end point on the drawing region through which a straight line passes should be calculated from an equation of the straight line. Thereafter, using a dot generator, dots on a segment connecting the start point and the end point are generated and are produced onto the display screen.

However, the above-mentioned conventional drawing method has problems as described below. A first problem stems from the resolving power of the display screen that corresponds to a gap between the two neighboring dots to be described. For instance, a point of intersection calculated from two linear equations does not come into correct agreement with a point of intersection of a straight line formed by dots produced on the display screen. With the conventional system in which a point of intersection of a given straight line and a frame of the drawing region is calculated to find start points and end points of segments to be drawn, therefore, if it becomes necessary to change a relationship of superposition of windows in order to display a figure in addition to portions that have hitherto been concealed in a window, the boundary becomes discrete between a portion of figure that has already been described and a portion of additional figure, producing a combined figure different from a figure to be obtained when they are described at one time. This becomes a serious problem in a multi-window type display system in which the figure is partly displayed, added or deleted frequently.

A second problem is concerned with a time required for judging the clipping. In the case of a circle or an ellipse that is often described, it is difficult to locally generate the dots based upon the calculation of points of intersection. Therefore, the dots are generated for the whole figure, and it is judged whether the dots are included in the regions to be described. Thus, if the clipping is judged for each dot, such an error of display does not develop as was the problem when a partial figure was additionally displayed as described above. However, as the structure of the region to be drawn becomes complex due to the superposition of windows, it also becomes difficult to judge the clipping for each dot. Therefore, the processing time is lengthened, and the drawing speed decreases.

BACKGROUND OF THE INVENTION

The object of the present invention is to provide a method of drawing figures, which enables the boundary to become continuous between a portion of figure that has been displayed and a portion of figure that is additionally displayed.

Another object of the present invention is to provide a method of drawing figures, which is capable of displaying figures at high speeds even in a complex drawing region.

A further object of the present invention is to provide a method of drawing figures, which is adapted to a multi-window system in which a plurality of window regions are set on a display screen, and which enables the displayed content of a particular window to be changed.

In order to achieve these objects according to the present invention, there is provided a method of drawing figures in a multi-window system in which a plurality of windows are set on a display screen, a window which is partly overlapped on other windows and is partly concealed is divided into a plurality of display or non-display subregions, and the displayed content is allowed to change according to each window that is designated, said method comprising:

a first step for inputting figure data to be displayed on said designated window;

a second step for successively generating position data of dots that constitute a figure based upon said figure data;

a third step which repeats a comparing of position data of the generated dots with position data of said window until a dot included in said designated window is found;

a fourth step for finding a particular subregion in said designated window in which is located a dot that is determined by said third step to be included in the designated window;

a fifth step which performs nothing if said particular subregion lies in the non-display region and which, if said particular subregion lies in the display region, produces a dot onto the display screen, and then compares the position data of a new dot generated next with the position data of said particular subregion, and repeats the same step until the new dot falls outside said particular subregion; and a sixth step which when the new dot falls outside said particular subregion in the fifth step, switches the region to be compared for the new dot, and compares it with the designated window of the third step or with the other subregion of the fourth step.

According to the present invention, when one of the dots constituting the figure is found to be located in a particular subregion in a designated window, a new dot that is subsequently generated is compared with the particular subregion, in order to determine whether the dot be produced onto the display screen or not. Thus, if the region to be compared with the dot is specified, most of the dot trains located in the window,can be clipped through one time of determination, and the figure can be drawn at high speeds.

The foregoing and other objects, advantages, manners of operation and features of the present invention will be understood from the following detailed description when read in connection with the accompanying drawings.

DESCRIPTION OF THE PREFERRED EMBODIMENTS

Figure 1:
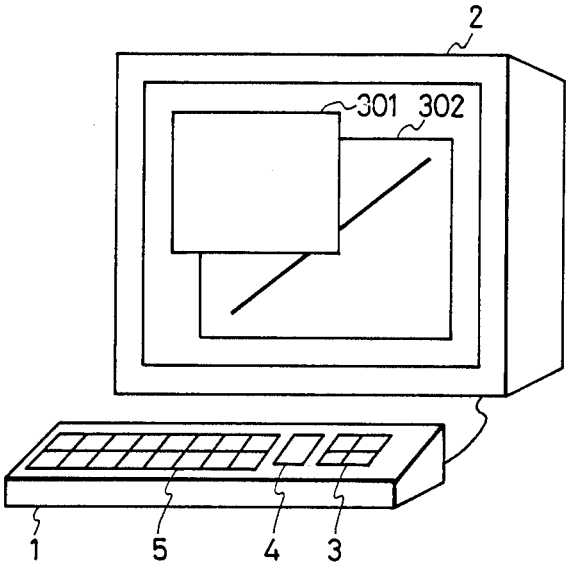
FIG. 1 is a diagram illustrating the appearance of a display unit to which the present invention is adapted.

FIG. 1 is a diagram illustrating the appearance of a dipplay device to which the present invention is adapted, wherein reference numeral 1 denotes a keyboard, and 2 denotes a display screen which consists of a cathode-ray tube. On the display screen are set two windows 301 and 302. The keyboard 1 is provided with keys 3 for moving the cursor on the screen, a key 4 for designating the input of cursor position, and a group of character keys 5 for inputting the data or command.

Figure 2:
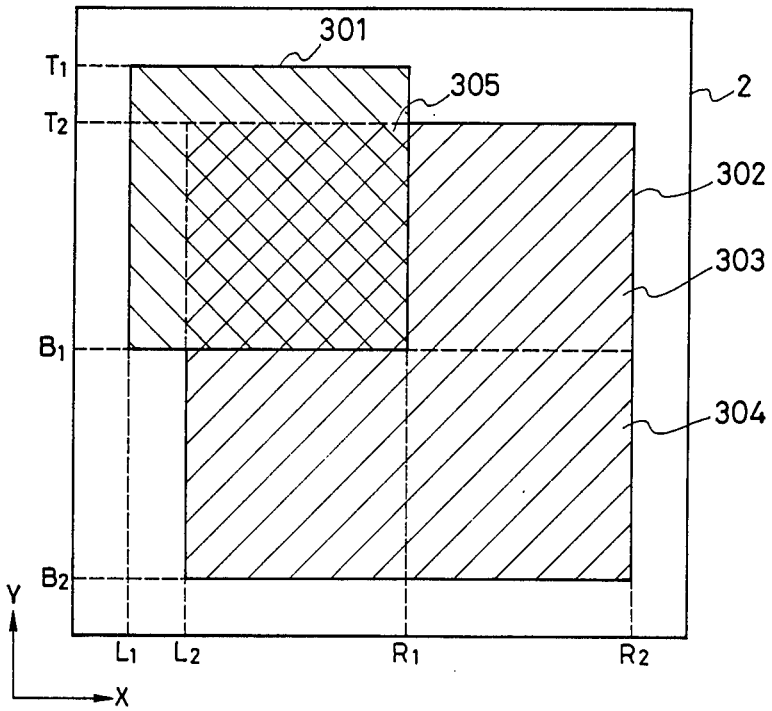
FIG. 2 is a diagram explaining a multi-window that is set on a display screen.

FIG. 2 is a diagram which explains in detail the windows on the display screen 2 on which the window 301 is set being partly overlapped on the window 302. The window 301 is defined by an X-coordinate $L_1$ of the left side, a Y-coordinate $T_1$ of the upper side, an X-coordinate $R_1$ on the right side and a Y-coordinate $B_1$ on the lower side. Similarly, the window 302 is defined by $L_2$, $T_2$, $R_2$ and $B_2$. Namely, positions and sizes of the windows are defined by X- and Y-coordinates of the left upper and right lower corners. Under the diagramed condition, the coordinate values have the following relationships:

$$L_1<L_2,\ B_1>B_2,\ R_1<R_2,\ T_1>T_2$$

It is now presumed that the window 302 is designated to draw the figure. With the window 302 being designated as a region where the figure is to be drawn, the drawing output is sent onto the region of the window 302 that has not been covered with the window 301 on the CRT, unless there is no designation to change the region. The window 302 is partly concealed by the window 301. To control the display, therefore, the window 302 is divided into three internal regions (subregions) 303, 304 and 305 and is controlled with the right side and the lower side of the window 301 as dividing lines. Like the windows 301 and 302, the subregions are defined by coordinate values of the left, upper, right and lower sides. Display subregions are formed by the subregion 303 defined by coordinate values $R_1$, $T_2$, $R_2$, $B_1$ and by the subregions 304 defined by coordinate values $L_2$, $B_1$, $R_2$, $B_2$. A non-display subregion is formed by the subregion 305 that is defined by coordinate values $L_2$, $T_2$, $R_1$ and $B_1$. Therefore, whether, for example, an X-coordinate Xc and a Y-coordinate Yc of a point (dot) that represents a figure are included in the display subregion 304 or not, is determined by judging if $L_2 \leqq Xc$, $R_2 \leqq Xc$, $B_2 \geqq Yc$, and $B_1 \leqq Yc$ all hold true or not.

Figure 3:
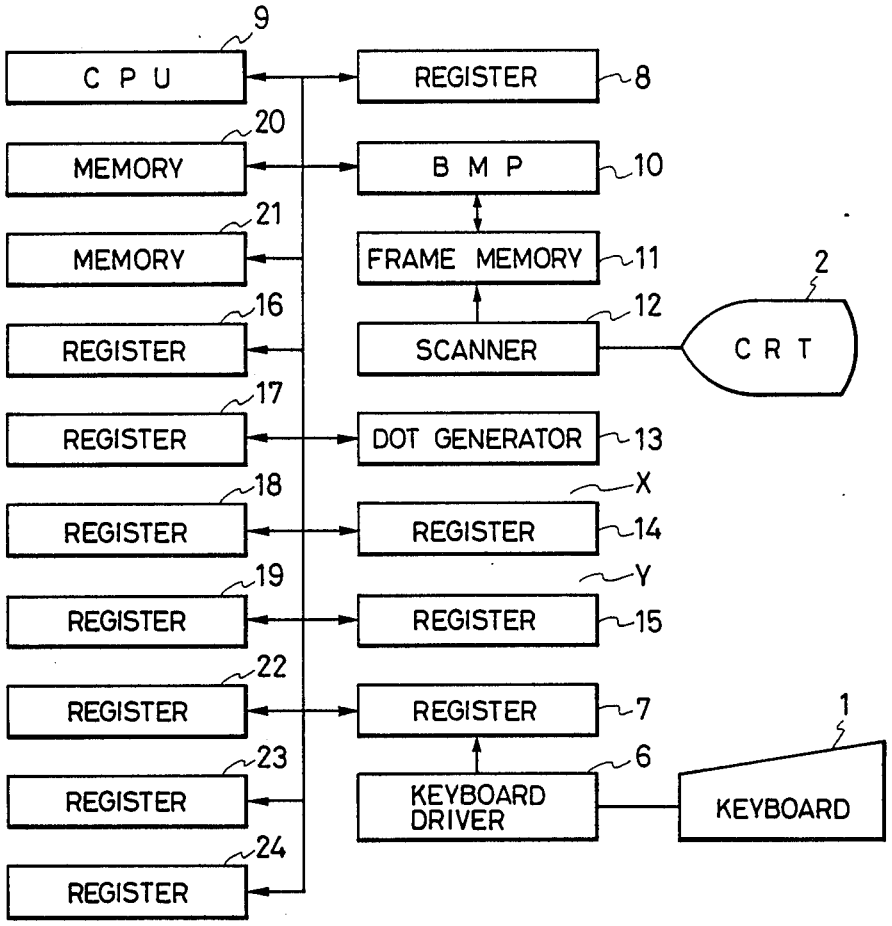
FIG. 3 is a block diagram illustrating the structure of a control circuit of the display unit for placing the present invention into practice.

FIG. 3 is a block diagram of a cnntrol system of the display device for realizing the figure drawing system of the present invention. If a key on the keyboard 1 is operated, a keyboard driver circuit 6 generates a code that corresponds to the operated key. The code is input to a register 7 and is read by a CPU 9. If the operator manipulates the character keys 5 to input a predetermined command, the CPU 9 executes a program that is stored in a memory 20 and that corresponds to the command. If the cursor moving key 3 on the keyboard is depressed, the CPU 9 moves the cursor on the display screen in accordance with a cursor control program and stores the cursor position in a register 8. Reference numeral 11 denotes a frame memory which stores dot data that is to be displayed on the display screen 2, and 12 denotes a scanner which scans the frame memory 11 and produces an output onto the CRT screen 2. The content of the frame memory 11 is rewritten by a bit map processor (BMP) 10 with a dot as a unit.

Reference numeral 13 denotes a dot generator which successively generates dots to constitute a designated figure in response to the instruction frqm the CPU 9. As will be described later in detail, after having confirmed the fact that a predetermined value (a maximum numerical value MAX in this embodiment) was set into the register 14 by the CPU 9, the dot generator 13 generates a next dot, stores an X-coordinate Px and a Y-coordinate Py of the dot on the display screen into registers 14 and 15, respectively, and remains in a standby state until a predetermined value is set again into the register 14. The CPU 9 transfers the coordinate values of the dot stored in the registers 14, 15 by the dot generator 13 into registers 22 and 23, and sets the predetermined value into the register 14.

Reference numeral 21 denotes a memory for storing a window control table that includes definition data of the windows set on the display screen, data related to the display priority of the windows, and definition data related to subregions of the windows. Reference numerals 16, 17, 18 and 19 are registers that store coordinate values (L, R, T, B) of four sides of a window or a subregion read from the memory 21. The CPU 9 compares the coordinate values Px, Py of dot stored in the registers 22 and 23 with the coordinate values stored in the registers 16 to 19, and determine whether the dot is the one that should be displayed or not. Reference numeral 24 denotes a register for storing a value that represents whether the region defined by the coordinate values of the registers 16 to 19 is a display region or a non-display region.

Figure 4:
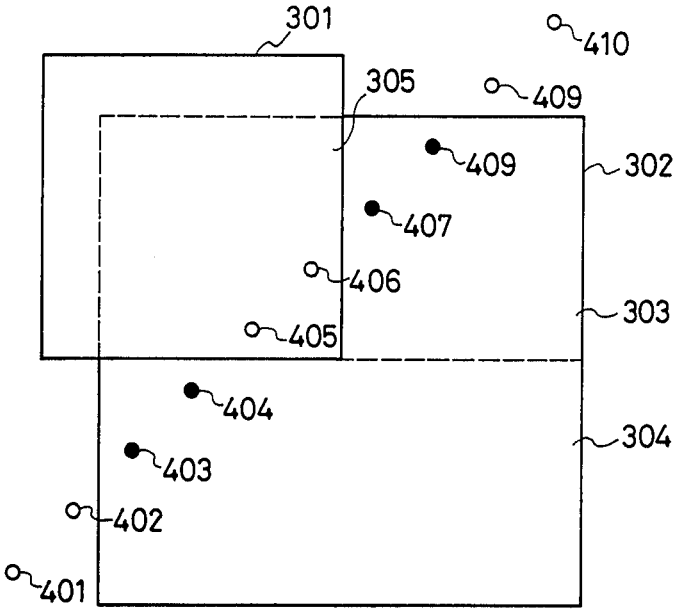
FIG. 4 is a diagram for explaining a relationship between a train of dots generated for drawing a figure and a window on the display screen.

Described below is how to draw a figure represented by a train of dots 401 to 410 on the window 302 in conjunction with FIG. 4. The dots are successively generated by the dot generator 13 in the order of the numbers 401, 402, 403, and so on.

When a dot is generated according to the present invention, it is determined if the dot is included in the window region 302 where the figure is to be drawn (compare with the window). The dots 401 and 402 that lie outside the window 302 are determined so as not to be displayed. It is the dot 403 that is determined, for the first time, to be located inside the designated window. Then, it is determined in which subregion of the window 302 the dot 403 is contained (compare with a subregion). In this embodiment, the dot 403 is contained in the display subregion 304, and is determined to be displayed and is, hence, written into the frame memory 11 (dot treatment in the subregion). The dot 404 is also contained in the display subregion 304 and is displayed. The dot 405, however, lies outside the display subregion 304. Therefore, the subregion is switched for the dot 405, and it is determined in which subregion the dot 405 is contained. It will be understood that the dot 405 is included in the non-display subregion 305. Dots subsequent to the dot 405 are also determined in regard to whether they are contained in the non-display subregion 305. If they exist in this region, they are all so treated as not to be displayed. The dot 407 lies outside the non-display subregion 305. Therefore, the subregion is switched again and it is determined in which subregion the dot 407 is contained. It is found that the dot 407 is contained in the display subregion 302, and is treated to be displayed and is written into the frame memory 11. The dot 408 that is generated next is also treated in the same manner. As for the dot 409 that lies outside the display subregion 303, it will be found that the dot 409 is contained in none of the subregions no matter how the subregion is switched. Therefore, the dot 409 is determined to lie outside the designated window 302 and is treated so as not to be displayed. The dots generated subsequent to the dot 409 are compared with the designated window 302. When the final dot 410 is determined so as not to be displayed, the processing for drawing the figure is completed.

Figure 5:
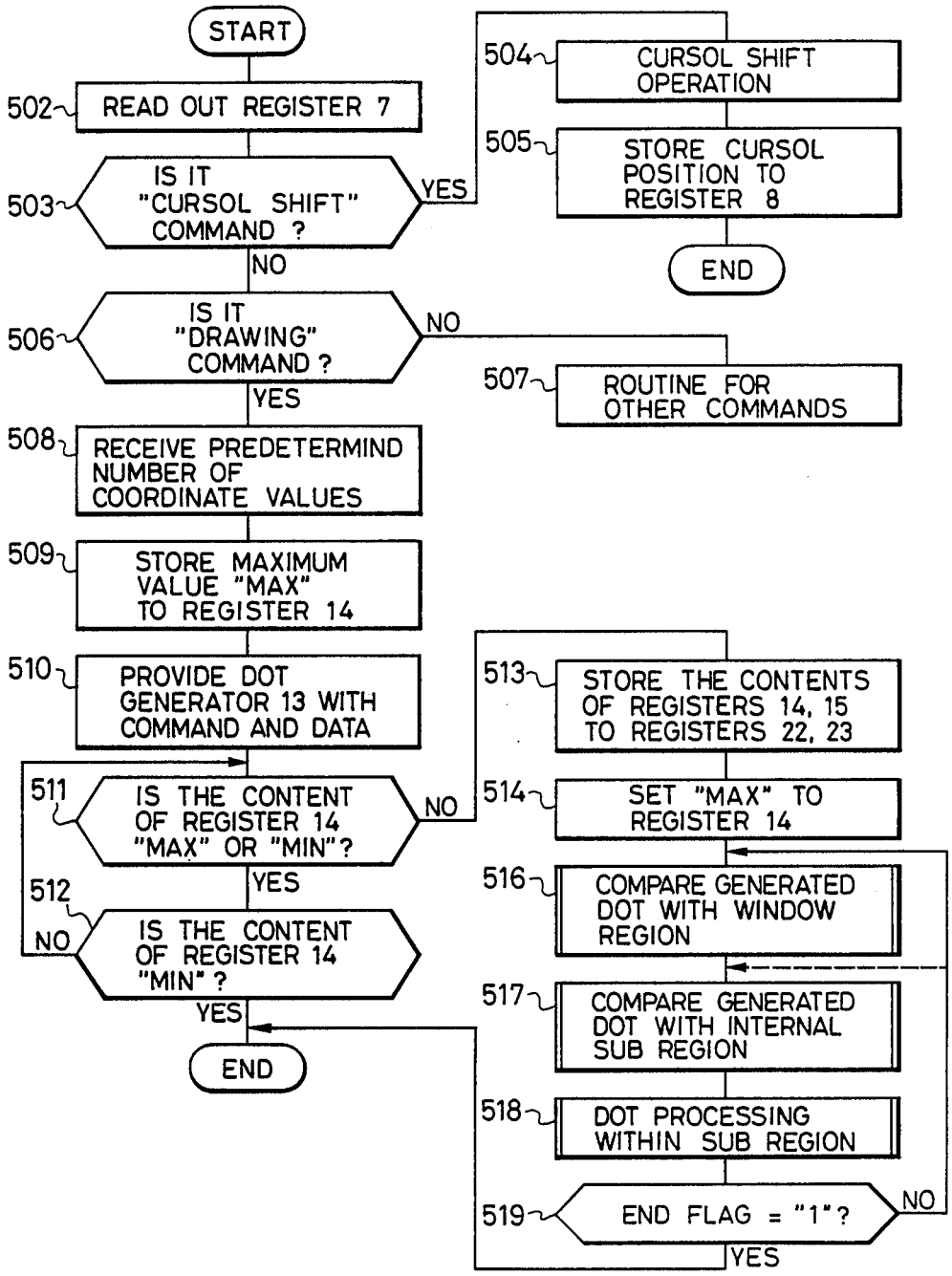
FIG. 5 is a flow chart of a control program for drawing the figure according to an embodiment of the present invention.

FIG. 5 is a flow chart of a program executed by the CPU 9 to carry out the above-mentioned processing for drawing figures.

The CPU 9 reads (step 502) the input code stored in the register 7. If the input code is a cursor shift command (step 503), the CPU 9 moves the cursor position on the display screen (step 504), and stores position coordinates of the cursor in the register 8 (step 505). If the input code is not a cursor shift command, the program proceeds to a step 506 where it is determined if the command is a drawing instruction. If it is not a drawing instruction, the program proceeds to a step 507 which performs other judgement and executes the process that correspond to the determined result. Here, however, these processes have no relation to the present invention and are not described.

If the input command is a drawing command, the program proceeds to a step 508 which waits for the input of coordinate values of a number corresponding to a figure that is to be drawn. If it is the instruction to draw a straight line, two coordinates that represent a start point and an end point of the line to be drawn are designated by the cursor position input keys 4. If it is the instruction to draw a circle, two coordinates are designated by the cursor position input keys 4, the first coordinate representing the center of the circle and the next coordinate representing a point on the circumference. After the coordinate values corresponding to the kinds of figures to be drawn are all input, the CPU 9 stores in the register 14 a maximum value "MAX" (step 509) as the status data which permits the generation of dot, and gives a drawing command and necessary data to the dot generator 13 (step 510).

Figure 9:
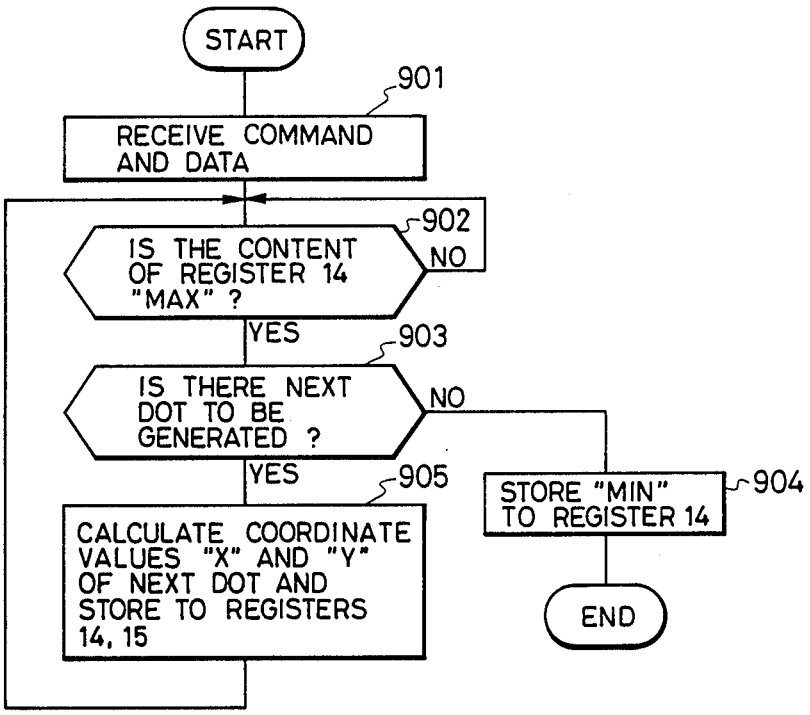
FIG. 9 is a flow chart illustrating the operation of a dot generator.

The dot generator 13 operates as shown in FIG. 9. That is, as the drawing command and data are received from the CPU 9 (step 901), a step 902 first determines whether the setpoint value of the register 14 is "MAX" or not. If "MAX" has been set to the register 14, it is so determined that the CPU 9 is ready to receive coordinate values of a new dot, whereby the program proceeds to a step 903 to determine if there still remain dots that have to be generated to draw the designated figure. If the dots have all been generated, a minimum value "MIN" is set to the register 14 (step 904) to inform the CPU 9 of the completion of the dot generation; i.e., the operation for generating dots is completed. If there still remain dots that have to be generated, the program proceeds to a step 905 to calculate the coordinates of a next dot P that expresses the figure based upon an equation that corresponds to the kind of a figure to be drawn and the data given from the CPU. Values of the X-coordinate Px and Y-coordinate Py are set to the registers 14 and 15, respectively. The program then returns back to the step 902, and remains in a standby state until the CPU 9 sets "MAX" again to the register 14.

Reverting to FIG. 5, the CPU 9 gives to the dot generator 13 an instruction to generate dots, and then judges if the content of the register 14 is "MAX" or "MIN" (step 511). If the content of the register 14 is "MIN", it is so determined that the process for drawing the figure this time is completed, and the program is finished (step 512). If the content of the register 14 remains "MAX", it is so determined that the next dot has not yet been generated by the dot generator 13, whereby the program returns back to the step 511 and remains at standby until the content of the register 14 is rewritten to a value other than "MAX". If the dot generator 13 sets the X-coordinate Px of the new dot P into the register 14, the program proceeds from the step 511 to the step 513, so that cocrdinate values Px, Py of the dot in the registers 14 and 15 are transferred onto the registers 22 and 23. Then, a step 514 sets "MAX" to the register 14. Then, the dot generator 13 is allowed to generate a next dot.

While the dot generator 13 is generating the next dot, the CPU 9 proceeds to a routine 516 where it is determined whether a point given by the coordinate values Px, Py stored in the registers 22 and 23 is contained in the designated window 302 or not. In the routine 516, coordinate values $L_2$, $R_2$, $T_2$ and $B_2$ of the left, right, upper and lower sides defining the window 302 to be determined are read from the memory 20, and are stored in the registers 16, 17, 18 and 19 (step 603). Then, these coordinate values are compared with the coordinate values Px, Py of the registers 22 and 23, in order to determine if the dot P is contained in the window 302 (step 604). If the dot is not contained in the window 302, the program returns back to the step 511 of FIG. 5 to wait for the generation of the next dot. If the dot is contained in the window 302, the program proceeds to a routine 517 of FIG. 5.

Figure 7:
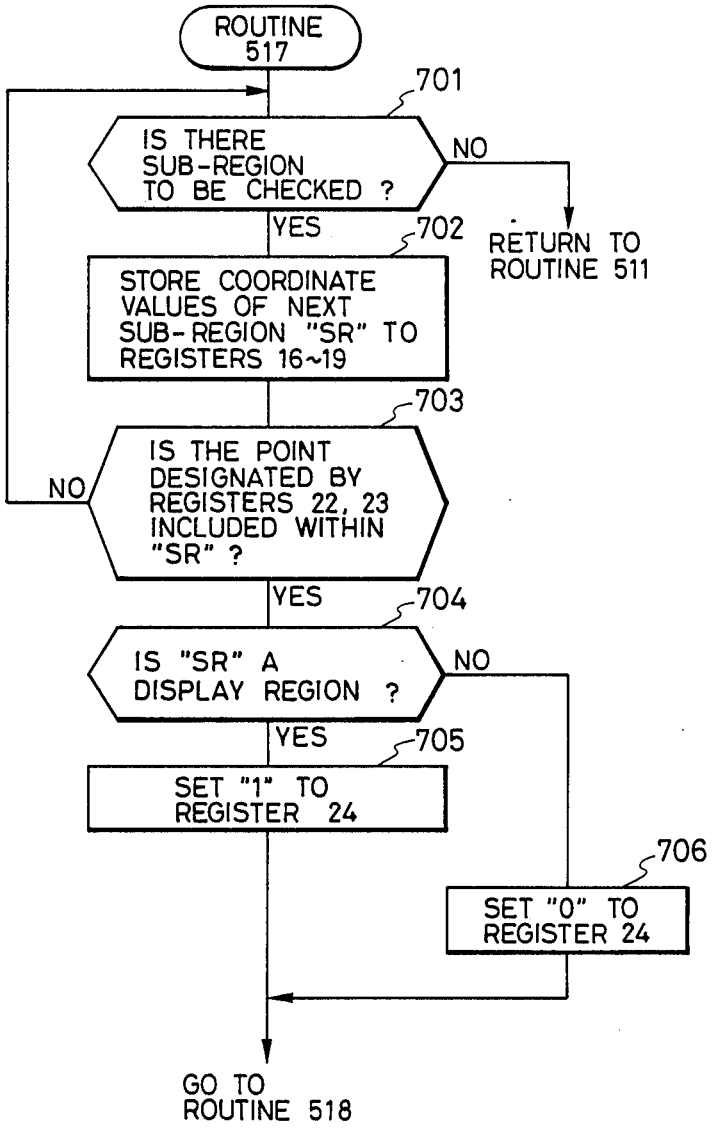
FIG. 7 is a flow chart illustrating the details of a routine 517 of FIG. 5.

The routine 517 determines in which one of the subregions 303, 304 or 305 constituting the window 302 the dot P is contained. Details of the routine 517 are shown in FIG. 7. In this routine 517, first, the presence of a remaining subregion to be collated with the dot P is examined (step 701) with reference to the memory 20. If there remains any subregion, coordinate values of the left, right, upper and lower sides defining the subregion "SR" to be collated are stored, i.e., $L_2$, $R_2$, $B_1$ and $B_2$ in the case of the subregion 304, for example, are stored in the registers 16, 17, 18 and 19, respectively (step 702). A step 703 determines if the dot P is contained in the subregion "SR" or not based upon the coordinate values Px, Py of the dot P stored in the registers 22, 23 and the coordinate values stored in the registers 16 to 19. If the dot P is not contained therein, the program returns back to the step 701 whereby the above-mentioned process is repeated for the next subregion. If the subregion SR that contains the dot P is found, it is determined whether the subregion SR is a display region or a non-display region (step 704) relying upon the window control data stored in the memory 20. If it is the display region, "1" is set to the register 24 (step 705) and if it is the non-display region, "0" is set to the register 24 (step 706), and the program proceeds to a routine 518 of FIG. 5. In the step 701, if there is no subregion to be collated with the dot P, the program returns to the routine 511 of FIG. 5.

Figure 8:
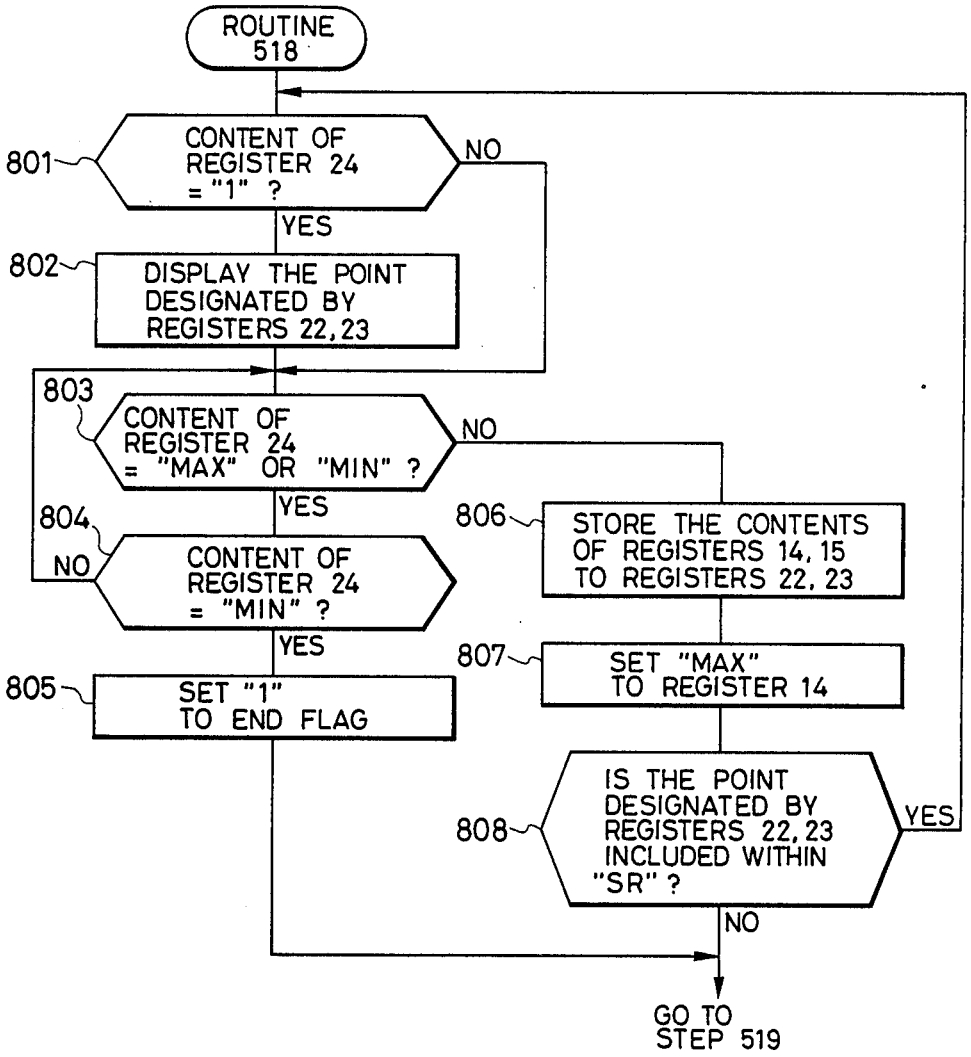
FIG. 8 is a flow chart illustrating the details of a routine 518 of FIG. 5.

The routine 518 is to treat the dot in the subregion "SR" specified by the routine 517. According to the present invention, if a dot on a figure is confirmed to be contained in a subregion "SR" that is a display region, it is presumed that a dot that is subsequently generated also exists in the subregion "SR", such that determination can be made at high speeds in regard to whether the newly generated dots are to be displayed or not. As shown in FIG. 8, the routine 518 first determines the content of the register 24 (step 801). If the register 24 is storing the value "1", an instruction is given to the BMP 10 (step 802) so that the dot of coordinate values stored in the registers 22 and 23 is displayed on the display screen. If the register 24 is storing "0", nothing is performed and the program proceeds to a step 803 which determines if the content of the register 14 is "MAX" or "MIN" like the step 511 of FIG. 5. If the content is "MIN", the END FLAG which indicates the completion of the process for drawing figure of this time is set to "1" (step 805), and the program proceeds to a step 519. If the content is "MAX", the program remains standby until the content of the register 14 is rewritten by the dot generator 13. If an X-coordinate of a dot newly generated by the dot generator 13 has been set to the register 14, the program proceeds from the step 803 to a step 806 whereby the coordinate values Px, Py stored in the registers 14 and 15 are transferred onto the registers 22 and 23. A step 807 sets "MAX" to the register 14 so that the dot generator generates a next dot. A dot represented by new coordinate values Px, Py is compared in a step 808 with the coordinate values of the subregion "SR" stored in the registers 16 to 19. If it is contained in the subregion SR, the program returns to the step 801. If not, the program proceeds to the step 519 of FIG. 5.

The step 519 of FIG. 5 determines the value of the END FLAG. If the END FLAG is "1", the process for drawing the figure is finished. If the END FLAG is "0", the program returns to the routine 516 to collate a new dot that lies outside the subregion "SR" with the window 302. Then, the routine 518 determines at a high speed whether a continuous train of dots in the same subregion SR be displayed or not. As for the dots that lie outside the subregion SR, the region to be collated is expanded to the window region 302 to determine again whether such dots be displayed or not. Therefore, the figure can be drawn at high speeds compared with the method according to which all dots are determined in the order of the window region and the subregions.

In the above-mentioned embodiment, in case a newly generated dot lies outside the subregion "SR" in the routine 518, the program returns to the routine 516 to collate it with the window 302. As indicated by a broken line in FIG. 5, however, it is also allowable to return the program from the step 519 to the routine 517 to search for other subregions that contain the dot. Since the window is divided into a plurality of subregions, it is considered that the dot that lies outside a given subregion still exists in the window and is contained in another subregion. Therefore, if other subregions that may contain the dot are searched for, the number of processing steps can be reduced compared to the case of returning the program to the routine 516.

According to the presnt invention, dots forming a line of figure are successively generated, and dots located in a display subregion in the window are seletted and are written onto the frame memory. Therefore, even when a portion of the figure is concealed by other windows, the train of dots that are concealed being located in a non-display subregion maintains a relationship of positions continuous to the train of dots that are now displayed being located in the display subregion. Therefore, even if the non-display subregion turns into the display subregion due to the change in the display priority of windows, a train of dots that are newly added onto the screen can be displayed continuously with the train of dots that have been displayed. Namely, there is no disturbance in the dot positions on the boundaries among the subregions on the display screen.

Figure 6:
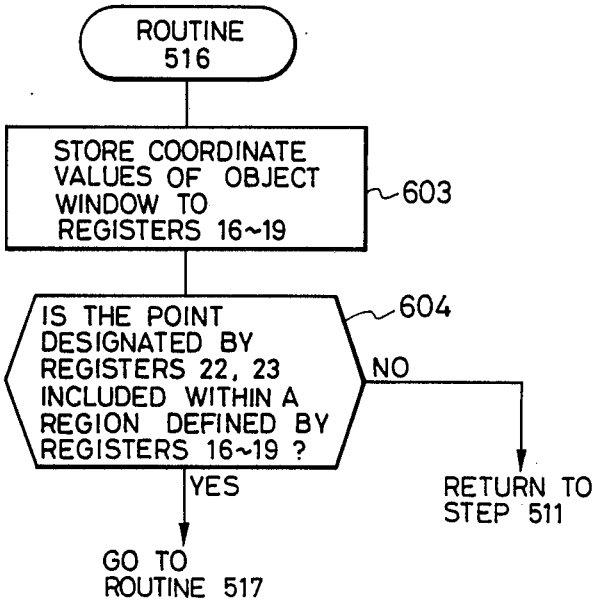
FIG. 6 is a flow chart illustrating the details of a routine 516 of FIG. 5.

In the foregoing was described an embodiment of the present invention in which a window was designated on the display screen and a figure was drawn in the window. However, the drawing system of the present invention can also be adapted to the case where partial figures at dissimilar positions on a figure are projected onto a plurality of windows on the display screen. In this case, each dot constituting the figure must be compared with a plurality of windows. When it is found that the dot is not contained in a window, it should be compared with other windows by modifying the flow chart of the routine 603 of FIG. 6. Further, the flow chart of routine 517 of FIG. 7 which compares the dot with a subregion in the window, should be so modified that the program returns from the step 701 to the routine 516 when the comparison is finished for all of the subregions.

We claim:

1. A method of drawing figures in a multi-window system in which a plurality of windows are set on a display screen, and wherein a window which is partly overlapped by other windows and is thus concealed is divided into a plurality of subregions defined as display or non-display subregions, and the displayed content is allowed to change for each of the windows that are designated, said method of drawing figures comprising:

a first step of inputting figure data to be displayed in a designated window;

a second step of successively generating position data of dots that constitute a figure based upon said figure data;

a third step of repeating a comparison of position data of each generated dot with position data of said window until a dot included in said designated window is found;

a fourth step of finding a particular subregion in said designated window in which is located a dot that is determined by said third step to be included in the designated window;

a fifth step of producing no dot on the display screen if said particular subregion is a non-display subregion, and which, if said particular subregion is a display subregion, produces a dot on the display screen;

a sixth step of comparing the position data of each new dot generated after the dot found in said third step with the position data of said particular subregion and repeating the fifth step until a new dot is found to lie outside said particular subregion; and repeating said third through sixth steps, when the new dot is found to lie outside said particular subregion.

2. A method of drawing figures according to claim 1, wherein the dot position data is generated in said second step in such a manner that next dot position data is generated every time after the comparison is effected in said third step and in said fifth step.

3. A method of drawing figures in a multi-window system in which a plurality of windows are set on a display screen, and wherein a window which is partly overlapped by other windows and is thus partly concealed is divided into a plurality of subregions defined as display or non-display subregions, and the displayed content is allowed to change for each of the windows that are designated, said method of drawing figures comprising:

a first step of inputting figure data to be displayed on said designated window;

a second step of successively generating position data of dots that constitute a figure based upon said figure data;

a third step of reating a comparison of position data of each generated dot with position data of said window until a dot included in said window is found;

a fourth step of finding a particular subregion in said designated window in which is located a dot that is determined by said third step to be included in the designated window;

a fifth step of producing no dot on the display screen if said particular subregion is a non-display subregion, and which, if said particular subregion is a display subregion, produces a dot no the display screen;

a sixth step of comparing the position data of each new dot generated after the dot found in said third step with the position data of said particular subregion and repeating the fifth step until a new dot is found to lie outside said particular subregion; and a seventh step of replacing the particular subregion with another subregion when the new dot lies outside said particular subregion in the sixth step, by repeating said fourth step to specify another subregion in which said dot is located.

4. A method of drawing figures according to claim 3, wherein the dot position data is generated in said second step in such a manner that next dot position data is generated every time after the comparison is effected in said third step and in said fifth step.

* * * * *